United States Patent [19]

Kobayashi

[11] Patent Number: 4,890,840

[45] Date of Patent: Jan. 2, 1990

[54] WOOD-TYPE GOLF CLUB HEAD FOR NUMBER ONE GOLF CLUB

[75] Inventor: Masashi Kobayashi, Matsudo, Japan

[73] Assignee: Maruman Golf Co., Ltd., Tokyo, Japan

[21] Appl. No.: 159,095

[22] Filed: Feb. 23, 1988

[30] Foreign Application Priority Data

Feb. 25, 1987 [JP] Japan ..... 62-40436

[51] Int. Cl.[4] ..... A63B 53/04

[52] U.S. Cl. ..... 273/167 H; 273/167 F

[58] Field of Search ..... 273/164, 167 F, 167 H, 273/167 A, 167 E, 169–172

[56] References Cited

U.S. PATENT DOCUMENTS

| | | | |
|---|---|---|---|
| 1,396,470 | 11/1921 | Taylor | 273/167 E |
| 1,524,488 | 1/1925 | Read | 273/169 |
| 1,538,415 | 5/1925 | Tootle et al. | 273/172 |
| 2,457,084 | 12/1948 | Kearsley et al. | 273/169 |
| 2,859,972 | 11/1958 | Reach | 273/167 F |
| 3,556,532 | 1/1971 | Ballmer | 273/169 |
| 3,941,390 | 3/1976 | Hussey | 273/169 |
| 3,966,210 | 6/1976 | Rozmus | 273/169 |
| 4,021,047 | 5/1977 | Mader | 273/167 H |
| 4,313,607 | 2/1982 | Thompson | 273/167 H |
| 4,553,755 | 11/1985 | Yamada | 273/167 F |
| 4,754,976 | 7/1988 | Pelz | 273/164 |

OTHER PUBLICATIONS

Golf Digest, "Can Metal Woods Help Your Game?", Dec. 1981, pp. 57–59.

*Primary Examiner*—Edward M. Coven
*Assistant Examiner*—Benjamin Layno
*Attorney, Agent, or Firm*—Armstrong, Nikaido, Marmelstein, Kubovcik & Murray

[57] ABSTRACT

A number one wood-type golf club head comprising a body made of wood. A sole plate is secured to the bottom surface of the wooden body, and at least one cavity is provided in the wooden body and having an opening at the bottom surface, to thereby allow the golf club head to be elongated; the body having a length between a front end and a rear end thereof, from the viewpoint of the swing of the golf club, of more than 83 millimeters. This provides for a greater moment of inertia to obtain a stable drive.

3 Claims, 2 Drawing Sheets

WOOD-TYPE GOLF CLUB HEAD FOR NUMBER ONE GOLF CLUB

BACKGROUND OF THE INVENTION

1. Field of the Invention

The present invention relates to an improvement of the head of a wood-type golf club, made substantially of wood, and known as a number one wood, i.e., a driver.

2. Description of the Related Art

In general, golf is played with a plurality of golf clubs comprising a set. A certain relationship must exist between the golf clubs in the set, to provide a balanced swing weight or a constant swing feeling, and thus the weight of the head of each golf club must be restricted. In the case of the driver, it is considered that the weight of the head should be approximately two hundred grams, and therefore, this weight restriction must be taken into account when designing a driver.

U.S. Pat. No. 1,538,415, issued to M. Tootle 3D, et al. on May 19, 1925, discloses a typical driver having a wood-type club head with a sole plate attached to the bottom surface thereof. The sole plate in this patent carries a weight. As is well known, the wooden head of the driver has a solid structure and a weight such as a block of lead is inserted in the wooden head to adjust the weight thereof as desired.

Other types of drivers made of metallic materials are known. For example, U.S. Pat. No. 4,313,607, issued to Thompson on Feb. 2, 1982, discloses a metallic head of a driver comprising a contoured hollow metallic shell, synthetic plastic material filled in the interior cavity of the shell, and a reinforcing strut extending transversely and between the walls of the shell, and U.S. Pat. No. 4,021,047, issued to Mader on May 3, 1977, discloses a metallic head of a driver comprising a contoured metallic shell with an upper opening and a wooden cap fitted on the upper opening to form an air chamber within the club head. In contrast to the wooden club head, the weight of the metallic head of a driver can be adjusted by providing a cavity or a chamber within the metallic shell.

Nowadays, a wood-type club head having a solid structure is popular with many players, because the feel of the wooden club head upon impact with a golf ball is superior to that engendered by the metallic club head having a hollow structure, or by a fiber reinforced club head. However, the weight of the conventional wooden club head for a driver must be restricted to approximately two hundred grams, and thus the size of the head is restricted. Specifically, a length of the head, as viewed transversely of the head, or measured horizontally between a front end and a rear end thereof from the viewpoint of the swing of the golf club, is necessarily less than 80 millimeters. As a result, the moment of inertia of the wooden club head, which is calculated around a vertical axis passing through the center of gravity of the head, becomes smaller than that of the metallic hollow head, bringing a disadvantage to the wooden club head in that the direction of flight of the golf ball will not be always as desired and the distance of flight will be reduced if the player hits the golf ball at a point other than the sweet spot of the club head. Therefore, it is difficult for a beginner to obtain a stable drive with the driver.

SUMMARY OF THE INVENTION

An object of the present invention is to provide a wood-type golf club head for a number one golf club, i.e., a driver, which provides a greater moment of inertia to the wood-type golf club head, which moment is calculated around a vertical axis passing through the center of gravity of the club head, to obtain a stable drive with the golf club.

According to the present invention, there is provided a wood-type golf club head for a driver, the golf club head comprising a body made of wood and substantially in the shape of a golf club head having a bottom surface, and a sole plate secured to the bottom surface of the body; wherein at least one cavity is provided in the body and the bottom surface has an opening covered by the sole plate, and the club head has a length between a front end and a rear end thereof from the viewpoint of the swing of the golf club, of more than 83 millimeters.

With this arrangement, it is possible to maintain the weight of the club head within the required restriction (approximately 200 grams) by balancing the decreased weight by the provision of the at least one cavity and the increased weight by the elongated length of the club head, as defined, of more than 83 millimeters. The elongated length of the club head allows the club head to have a greater moment of inertia, which is calculated around a vertical axis passing through the center of gravity of the club head. Therefore, the problem of an incorrect direction of flight of the golf ball and a reduced distance of flight when the golf ball is hit at a point other than the sweet spot of the club head, is solved, and thus even a beginner can obtain a more stable drive. Also, the external size of the golf club head can be made larger, which allows the player to easily hit the golf ball at the sweet spot of the club head, and thus obtain a stable drive.

BRIEF DESCRIPTION OF THE DRAWINGS

The present invention will become more apparent from the following description of the preferred embodiments with reference to the accompanying drawings, in which.

DESCRIPTION OF THE PREFERRED EMBODIMENTS

Figure 1:
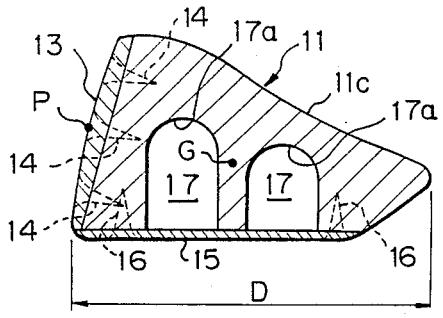
FIG. 1 is a transverse sectional view of a wood-type golf club head for a driver according to a preferred embodiment of the present invention, and taken along the line I—I in FIG. 2.
Figure 2:
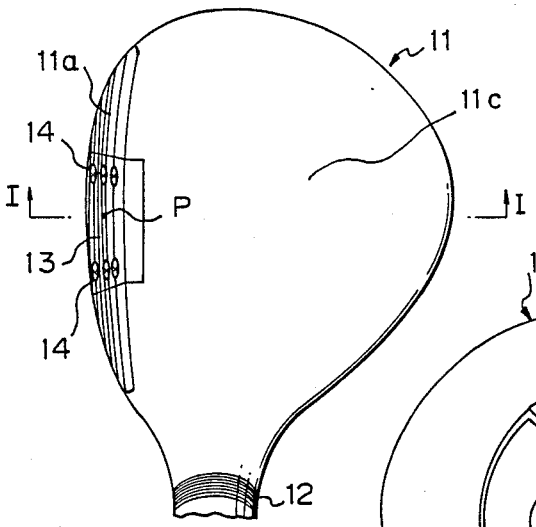
FIG. 2 is a plan view from above of the head of FIG. 1.
Figure 3:
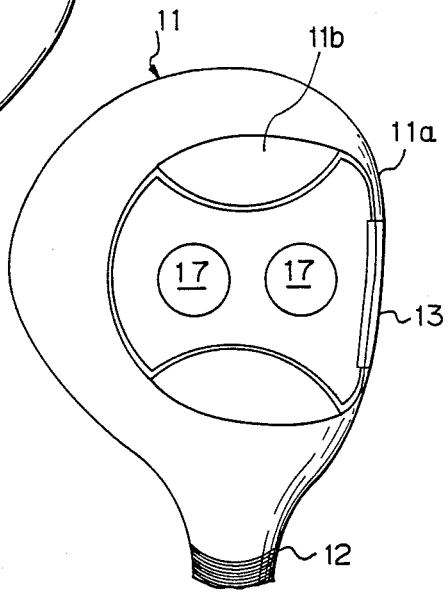
FIG. 3 is a bottom view of the head of FIG. 1, with the sole plate removed.

Referring to FIGS. 1 to 3, the wood-type golf club head for the driver, according to the present invention, comprises a body 11 made of wood and having a solid structure substantially in the shape of a golf club head. A hosel portion 12 is integrally formed with the body 11. The body 11 has an upward and rearward inclined front surface ll*a* having a central recessed portion in which a front plate 13 of a synthetic resin material is fitted to constitute a hitting face. The front plate 13 is fixed to the body 11 by screws 14. The body 11 also has a bottom surface 11*b* having a central recessed portion in which a metallic sole plate 15 is fitted. The sole plate 15 is fitted to the body 11 by screws 16.

Two cavities 17 are provided in the body 11 and have openings respectively in the bottom surface 11*b*, which are covered by the sole plate 15. The two cavities 17 have central axes respectively which extend perpendicular to the bottom surface 11*b* and are aligned with each other in a vertical plane perpendicular to the front surface 11*a*. The center of gravity of the club head is represented by G and the sweet spot is represented by P. The above stated vertical plane passes through the center of gravity G and the sweet spot P, and thus is perpendicular to the front surface 11*a*, and the two cavities 17 are located in such a manner that the center of gravity G lies between the two cavities 17.

The two cavities 17 have blind ends 17*a* opposite to the openings, and having a semispherical shape, respectively. The blind ends 17*a* can have other shapes, for example, a flat shape, but if the blind ends 17*a* have a flat shape, a concentration of stress occurs at the peripheral edge of the flat blind ends 17*a*, decreasing the strength of the club head. Therefore, the blind ends 17*a* preferably have a semispherical shape to prevent such a reduction of the strength of the club head due to the provision of the cavities 17.

The golf club head has a length D between a front end (bottom end of the front plate 11*a*) and a rear end thereof, as measured horizontally, or as measured between the projections of the front and rear ends on the horizontal plane, from the viewpoint of the swing of the golf club. According to the present invention, this length D is more than 83 millimeters. This is clearly distinctive from the head of a conventional wood-type driver, which has a length D, as similarly measured of less than 80 millimeters. Also, the body 11 has an upper surface 11*c* merging from the upper end of the front surface 11*a* and sloping rearward. The upper surface 11*c* has a shallow concave profile which allows or assists the elongation of the club head, as can be clearly seen from FIG. 1. In contrast, the upper surface of the conventional wood-type golf club head has a convex profile.

As described above, it is possible to maintain the weight of the golf club head within the required restriction (approximately 200 grams) by balancing the decreased weight by the provision of the cavities and the increased weight by the elongated length D of the head of more than 83 millimeters. The elongated length D of the head gives a greater moment of inertia to the wood-type golf club head, which moment is calculated around a vertical axis passing through the center of gravity of the club head.

Samples of the wood-type golf club heads were manufactured according to the present invention and other reference samples are manufactured according to the conventional design. All samples were made from persimmon, and had an identical loft angle of 12 degrees. The weight of the samples of the conventional type club head was set to approximately 197 grams, including the insertion of a lead weight of approximately 8 grams. The weight of the samples of club head of the present invention was set to approximately 197 grams, including a total volume of the cavities 17 of approximately 14 cubic centimeters.

The samples of the conventional type club head had a length D of approximately 76.7 millimeters, a height (from the top to the bottom of the front plate 13) of 44 millimeters, and a volume of 199 cubic centimeters. The samples of the club head of the present invention had a length D of approximately 88 millimeters, a height of approximately 50 millimeters, and a volume of approximately 240 cubic centimeters. Accordingly, the volume of the samples of the club heads of the present invention was increased by twenty percent compared to the samples of the conventional type club head.

The calculation of the moment of inertia of the wood-type golf club head around a vertical axis passing through the center of gravity thereof shows that the moment of inertia of the samples of the conventional type club head is approximately 1739 grams square centimeters ($gcm^2$) and that of the samples of the present invention is approximately 2260 grams square centimeters ($gcm^2$). Therefore, the moment of inertia of the club heads of the present invention was increased by approximately thirty percent compared to the samples of the conventional type club head.

As described, according to the present invention, it is possible to increase the moment of inertia of the wood-type golf club head around a vertical axis passing through the center of gravity of the club head. Therefore, the problem of an incorrect direction of flight of the golf ball and a reduced distance of flight when the golf ball is hit at a point other than the sweet spot may be solved, and thus even a beginner can obtain a more stable drive. Also, the external size of the club head can be made larger, which enables the player to easily hit the golf ball at the sweet spot of the club head, and thus obtain a stable drive.

Figure 4:
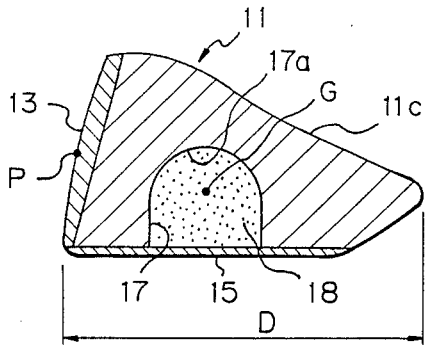
FIG. 4 is a transverse sectional view of a wood-type golf club head for a driver according to a second embodiment of the present invention, and taken along the line IV—IV in FIG. 5; and, FIG. 5 is a bottom view of the head of FIG. 4, with the sole plate removed.
Figure 5:
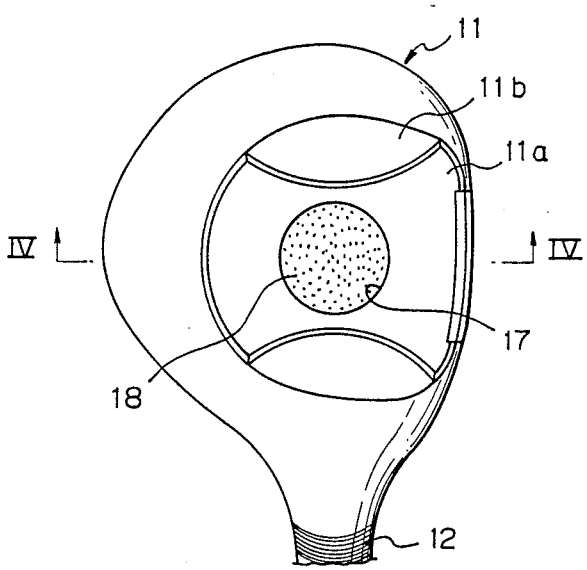

FIGS. 4 and 5 show a second embodiment of the present invention, in which like elements are represented by the same numerals as used in FIGS. 1 to 3. In FIGS. 4 and 5, one cavity 17 is provided in the body 11 of the wood-type golf club head for the driver and the cavity 17 also has an opening at the bottom surface and a blind end having a semispherical shape. The volume of the cavity 17 is equal to the total volume of the two cavities in the first embodiment. The cavity 17 extends perpendicular to the bottom surface 11*b* and is located generally centrally in the bottom surface 11*b*. One cavity 17 is located in such a manner that the center of gravity G of the club head lies within the cavity 17. The cavity 17 is symmetrical relative to a vertical plane passing through the center of gravity G and the sweet spot P, i.e., a vertical plane perpendicular to the bottom surface 11*b* and to the front surface 11*a*. Also, the length D of the head is more than 83 millimeters and the upper surface 11*c* of the body 11 has a shallow concave profile.

The cavity 17 can be empty as in the previous embodiment, but it is possible to fill the cavity 17 with any lightweight material, such as a urethane foam 18, to improve the strength of the body 11. The urethane foam 18 can be inserted in the cavity 17 after a foaming treatment is carried out outside of the cavity 17. Also, it is possible to insert the forming materials in the cavity 17 and then carry out a reaction into foam in the cavity 17, to obtain an intimate contact between the foam 18 and the wall of the cavity 17.

In this embodiment also, the weight of the club head is maintained at approximately 200 grams but the moment of inertia around a vertical axis passing through the center of gravity can be increased, enabling an increase in the size of the wood-type golf club head for a driver.

While the present invention is described with reference to the illustrated embodiments, the present invention is not limited to such illustrated embodiments and it should be understood that many modifications can be made thereto within the scope of the present invention. For example, it is possible to change the number and position of the cavity(s) as necessary. It is also possible to provide a separate hole and insert therein a weight for adjusting the weight of the club head. Further, a lightweight foam can be inserted in the cavities in the first embodiment, shown in FIGS. 1 to 3. Also, the wood from which the club head is formed is not limited to persimmon, and another natural wood, or a plywood, can be used.

What is claimed is:

1. A number one wood-type golf club i.e., a driver, which comprises:

a club head made of persimmon and having a bottom surface and a sole plate secured to said bottom surface;

said club head having a front surface to which a front plate is secured to constitute a face for hitting a golf ball and a length between said front plate and a rear end thereof, from the viewpoint of the swing of the golf club, of more than 83 millimeters;

said club head having at least one cavity therein opening at the bottom surface thereof to be covered by said sole plate, said at least one cavity having a blind end with a semispherical shape; and whereby said golf club has an increased moment of inertia and an increase in the possibility of obtaining a square hit with said golf club.

2. A number one wood-type golf club i.e., a driver, which comprises:

a club head made of persimmon and having a bottom surface and a sole plate secured to said bottom surface;

said club head having a front surface to which a front plate is secured to constitute a face for hitting a golf ball and a length between said front plate and a rear end thereof, from the viewpoint of the swing of the golf club, of more than 83 millimeters;

said club head having at least one cavity therein opening at the bottom surface thereof to be covered by said sole plate;

said at least one cavity comprising two cavities extending perpendicular to the bottom surface and in alignment with each other in a vertical plane perpendicular to said front surface; and whereby said golf club has an increased moment of inertia and an increase in the possibility of obtaining a square hit with said golf club.

3. A number one wood-type golf club, i.e., a driver, which comprises:

a club head made of persimmon and having a bottom surface and a sole plate secured to said bottom surface;

said club head having a front surface to which a front plate is secured to constitute a face for hitting a golf ball and a length between said front plate and a rear end thereof, from the viewpoint of the swing of the golf club, of more 83 millimeters;

said club head having at least one cavity therein opening at the bottom surface thereof to be covered by said sole plate;

said at least one cavity comprising two cavities extending perpendicular to the bottom surface and in alignment with each other in a vertical plane perpendicular to said front surface;

wherein said two cavities are located in such a manner that the center of gravity of said golf club head lies between said two cavities; and whereby said golf club has an increased moment of inertia and an increase in the possibility of obtaining a square hit with said golf club.

* * * * *